US007187134B2

(12) United States Patent
Zipf

(10) Patent No.: US 7,187,134 B2
(45) Date of Patent: Mar. 6, 2007

(54) METHOD OF TRIGGERING AT LEAST ONE ILLUMINATING MEANS AND TRIGGERING CIRCUIT FOR PRACTICING SUCH METHOD

(75) Inventor: Volker Zipf, Plochingen (DE)

(73) Assignee: Schefenacker Vision Systems Germany GmbH (DE)

( * ) Notice: Subject to any disclaimer, the term of this patent is extended or adjusted under 35 U.S.C. 154(b) by 0 days.

(21) Appl. No.: 11/043,402

(22) Filed: Jan. 26, 2005

(65) Prior Publication Data

US 2005/0218837 A1 Oct. 6, 2005

(30) Foreign Application Priority Data

Jan. 26, 2004 (DE) ..... 10 2004 003 844

(51) Int. Cl.
*H05B 37/02* (2006.01)
*H05B 41/24* (2006.01)

(52) U.S. Cl. ..... 315/209 R; 315/211; 315/287; 315/308; 315/312

(58) Field of Classification Search ..... 315/209 R, 315/362, 246, 287, 291, 307, 312, 313, 210, 315/211, 299, 308
See application file for complete search history.

(56) References Cited

U.S. PATENT DOCUMENTS 4,430,684 A 2/1984 Lefebvre et al. ..... 361/98
4,739,226 A 4/1988 Murata ..... 315/224
5,608,290 A * 3/1997 Hutchisson et al. .... 315/200 A
5,783,909 A * 7/1998 Hochstein ..... 315/159
6,320,330 B1 * 11/2001 Haavisto et al. ..... 315/291
6,329,760 B1 * 12/2001 Bebenroth ..... 315/200 A
6,858,994 B2 * 2/2005 Vollrath ..... 315/200 A
2003/0085749 A1 * 5/2003 Xu et al. ..... 327/423
2003/0185011 A1 10/2003 Strazzanti ..... 365/318

FOREIGN PATENT DOCUMENTS

DE 39 34 421 C1 3/1991
DE 198 48 925 A1 4/2000
EP 1 161 121 A3 6/2004

* cited by examiner

*Primary Examiner*—Thuy Vinh Tran
(74) *Attorney, Agent, or Firm*—Warn, Hoffmann, Miller & LaLone, P.C.

(57) ABSTRACT

A system and method for illuminating a light source, particularly a vehicle light source. The light source receives a voltage signal causing the light source to be illuminated. A triggering circuit detects the voltage signal. If the voltage signal is at or below a predetermined value, then the triggering circuit maintains a switch closed so that the light source continuously receives the voltage signal. If the voltage signal goes above the predetermined value, the triggering circuit opens and closes the switch in a pulsed manner where the voltage signal applied to the light source is on during the pulses and off between the pulses so that the brightness of the light source remains substantially constant.

22 Claims, 2 Drawing Sheets

METHOD OF TRIGGERING AT LEAST ONE ILLUMINATING MEANS AND TRIGGERING CIRCUIT FOR PRACTICING SUCH METHOD

CROSS-REFERENCE TO RELATED APPLICATION

This application claims priority to German Patent Application No. 10 2004 003 844.9 filed on Jan. 26, 2004.

FIELD OF THE INVENTION

The present invention relates to a method of triggering at least one illuminating means, and to a triggering circuit for practicing such method.

BACKGROUND OF THE INVENTION

On motor vehicles, the illuminating means increasingly takes the form of LEDs. With these lamps, there is the problem that owing to the possible high operating voltages of the network aboard, which usually lie between 9 and 16 volts, the lamps generate great power losses at high voltages. If the lamps are designed for full brightness at the typical rated operating voltage of 13.5 V, distinctly higher power outputs result when such lamps are employed in a 16 V on-board network, since the bias resistance design boosts the current more than proportionally. The components present in the lamp, such as LEDs, resistors, elements of synthetic material and the like, thus reach their load limits, since the temperature in the lamp and on the conductor plates increases sharply owing to the more than proportional current increase. At today's packing densities of the LEDs in the lamps, safeties must be built into the lamp design for this reason. This leads to a high technical outlay. To keep it reasonably low, the brightness of the lamps is not fully utilized at rated voltage on this account. Also, cooling devices are provided, but this again leads to an additional design outlay.

Another problem consists in that present-day motor vehicle on-board networks always become unstable. This is attributable to the increasing number of auxiliary electrical systems with great current demand in the motor vehicle. Examples of such auxiliary electrical systems are electric steering, window raisers, accessory heating and the like. These systems are liable to frequent voltage breakdowns, especially in the case of fast-responding LED lamps specifically. These voltage breakdowns manifest themselves in clearly visible brightness fluctuations.

SUMMARY OF THE INVENTION

It is an object of the invention to configure the method and the triggering circuit that, with a simple design layout, dependable operation is assured.

By the method according to the invention, the illuminating means, preferably an LED, is operated in pulse mode when the preassigned current/voltage value is exceeded. If the initial voltage lies above this preassigned value, the said rise of initial voltage is compensated by the pulsed operation. This considerably reduces the power loss rise. Owing to the pulsed operation, brightness fluctuations of the illuminating means can be regulated out very well. If the supply voltage of the illuminating means remains below the current/voltage values, operation takes place with no pulses, so that no brightness is lost. Only at voltages above the preassigned current/voltage value will operation be switched to pulse mode with the triggering circuit according to the invention.

For triggering various illuminating means, the microcontroller advantageously comprises corresponding inputs and outputs. A plurality of illuminating means may be combined into one illuminating field. In a single lamp, several illuminating fields may be present. Thus such illuminating fields may, for example in the tail lamp of a motor vehicle, be the brake light, the tail light or the blinker. It is also possible to provide one lamp for one illuminating field in each instance. The distribution of the illuminating means over a single one or among a plurality of lamps may be determined arbitrarily. For these different configurations, a single microcontroller suffices, by which the various illuminating means may be switched to pulsed operation in the manner described.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
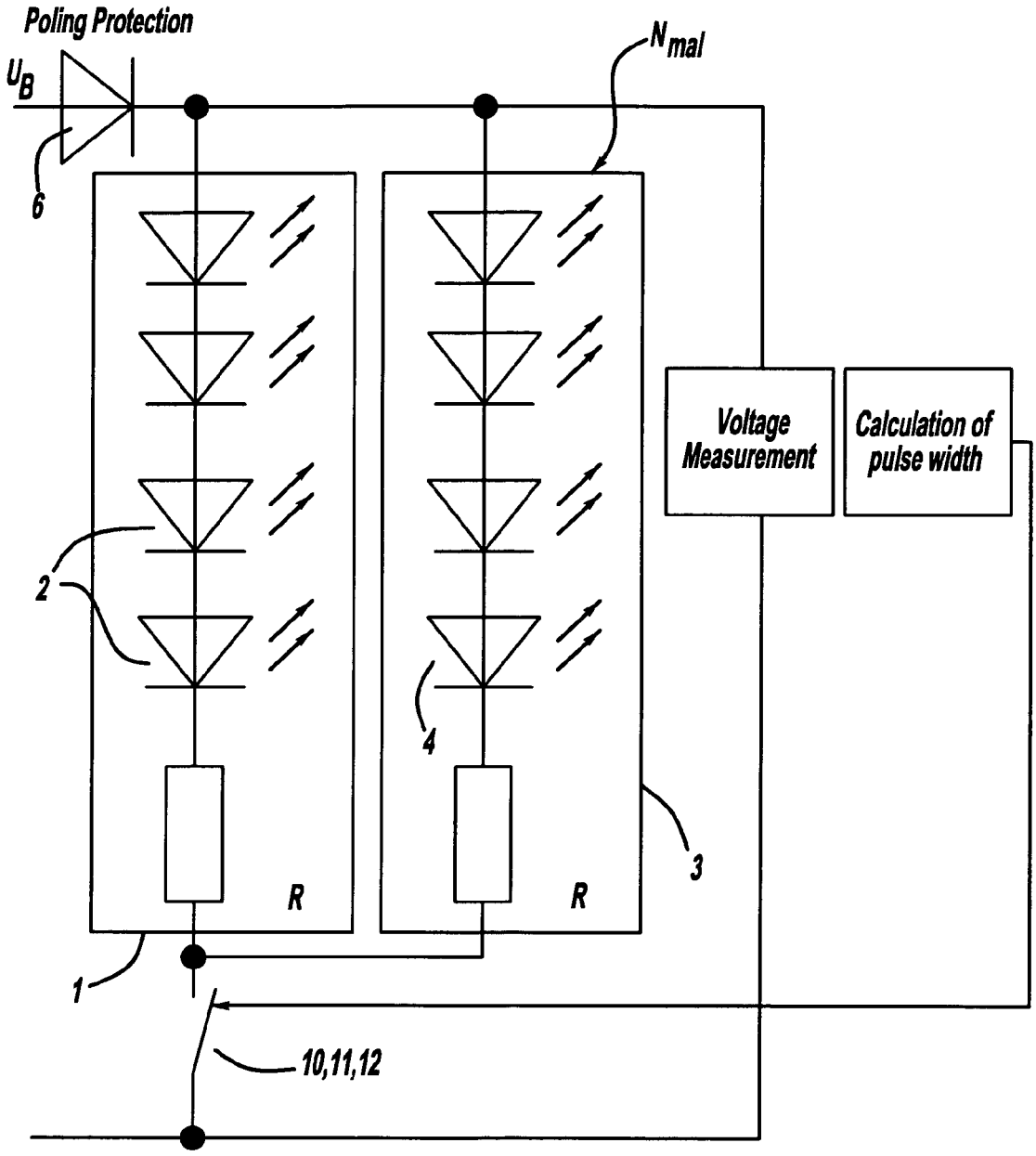
FIG. 1 shows a schematic diagram of a triggering circuit according to the invention.
Figure 2:
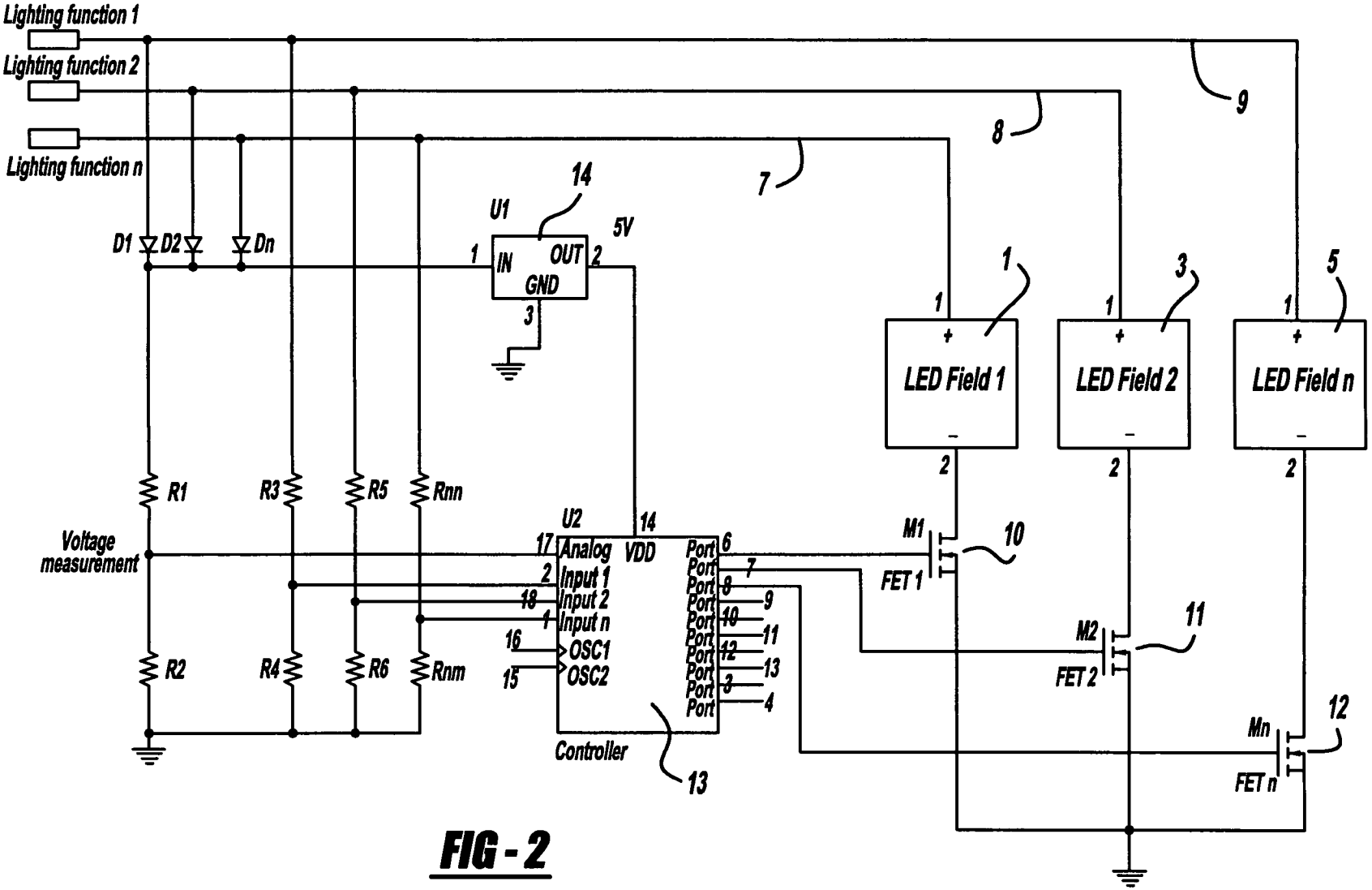
FIG. 2 shows an embodiment of the triggering circuit according to the invention by way of example.

The triggering serves to trigger illuminating means. In the embodiment shown by way of example, an illuminating field 1 comprises a plurality of illuminating means 2, preferably LEDs, connected in series. The illuminating field 1, for example, is provided with four illuminating means 2 connected in series. In FIG. 1, for example, an additional illuminating field 3 is represented, likewise comprising a plurality of illuminating means 4, preferably LEDs, connected in series one behind another. In this way, additional illuminating fields may be provided, circuited parallel to each other in each instance. In FIG. 2, for example, an additional third illuminating field 5 is represented, likewise comprising illuminating means in the form of LEDs. The LEDs form LED fields 1, 3, 5, each performing a lighting function.

The illuminating fields 1, 3, 5 are supplied with the on-board voltage of the motor vehicle. The on-board voltage is usually between 9 and 16 volts. The illuminating fields 1, 3, 5 are preceded by pole protection 6 (FIG. 1) in the form of a barrier diode. The illuminating fields represented by way of example may be the brake light, the stop light, the blinker, or the short-circuit lamp of the motor vehicle. Each illuminating field receives a voltage signal 7 to 9. Each illuminating field 1, 3, 5 is connected by way of a switch 10 to 12 to a microcontroller 13. The switches 10 to 12 are advantageously Mosfets, employed in a manner yet to be described for timing and/or pulsed operation of the illuminating means 2, 4 of the illuminating fields 1, 3, 5.

The voltage signals 7 to 9 are each supplied to a voltage component 14, connected to the VDD input of the microcontroller 13, by way of a diode D1, D2, Dn. By way of the diodes D1, D2, Dn, a part of the voltage is coupled out to the voltage supply of the microprocessor 13. The illumination desired for the particular illuminating field 1, 3, 5 is communicated to the inputs Input 1, Input 2, Input n as input signal. Each input Input 1, Input 2, Input n is preceded by a resistor R3, R5, Rnn.

By way of the input signals present at the inputs Input 1, Input 2, Input n, the desired light requirements for the particular illuminating field 1, 3, 5 are communicated to the microcontroller 13.

At the analog input 17 of the microcontroller 13, a fixedly adjusted portion of the input voltage $U_B$ for a measurement is available. With the resistors R1 and R2, the portion of the input voltage can be fixed. On the basis of the voltage signal present at the analog input 17, the brightness in the particular illuminating field can be compensated in each instance.

On the basis of the input signals present to the microcontroller 13 at the inputs Input 1, Input 2, Input n, the microcontroller generates voltage signals at the outputs port 6, port 7, port 8 with which the illuminating fields 1, 3, 5 are activated in the desired manner.

The voltage present at the particular illuminating field 1, 3, 5 is measured by means of the microcontroller 13. As soon as the voltage measured by the microcontroller 13 lies above the rated value, the microcontroller 13 triggers the corresponding switch 10, 11, 12. The rated value advantageously lies somewhat below the on-board network voltage $U_B$, so that in event of load collapse, sufficient regulating reserves will be available. As soon as the voltage lies above the rated value, the triggering circuit switches to pulse mode. The microcontroller 13 computes the pulse width on the basis of the input voltages present at Input 1, Input 2, Input n and, by way of the outputs port 6 to port 8, delivers corresponding signals to the switches 10 to 12. The pulse width is adjusted variably according to the input voltage. The switches 10 to 12 switch at very high frequencies, advantageously above 100 Hz. As a result, no stroboscopic effects occur, so that the LEDs 2, 4 do not flicker, so that no brightness fluctuations are apparent despite pulse mode. In this way, the loss increase is reduced.

In FIG. 1, the operation of the triggering circuit as described is represented schematically. As long as it is determined upon voltage measurements that the supply voltage of the illuminating fields lies below the rated value, the switches 10 to 12 remain closed. The LEDs 2, 4 are therefore not operated in pulse mode, so that the LEDs give off their light at optimum brightness. It is only at voltages lying above the rated value that there is a switch to pulse mode by way of the microcontroller 13, the switches 10 to 12 being actuated. The higher the supply voltage of the illuminating fields 1, 3, 5, the shorter the pulses.

The components of the triggering circuit are advantageously seated in the lamp. The voltage measurement might alternatively take place externally, outside of the lamp. The corresponding voltage values can then be supplied to the microcontroller 13 by way of a bus.

With the triggering circuit described, the rise of the power loss can be considerably reduced at the upper voltage limits, without need for any great outlay.

If for example the illuminating field 1 is dimensioned to a rated voltage of 13.5 volts, this will result in power loss of:

$$P_{tot}=U_{bat,\,nom}\cdot I_{LED,\,Target}$$

The bias resistance R (FIG. 1) figures out to:

$$R_{nom}=\frac{(U_{bat,nom}-U_{F,Dioden})}{I_{LED,Target}}$$

If the rated voltage is specified as 13.5 volts and the voltage of the diodes at 2.5 volts each, then for four diodes the voltage $U_{p,diodes}$ of 10 volts results. Further, it is assumed that the amperage $I_{LED,Target}$ is 60 mA.

From the above relationships, a bias resistance of 58 ohms and a power loss $P_{tot}$ of 0.81 watts results.

Now if the lamp is operated unpulsed at 16 volts, the resulting power loss is:

$$P_{tot}=U_{bat}\cdot I_{LED,actual}$$

Here the actual amperage can be calculated as follows:

$$I_{LED,actual}=\frac{(U_{bat}-U_{FDioden})}{R_{nom}}$$

If the rated battery voltage $U_{bat,nom}$ is assumed to be 16 volts, the diode voltage 2.5 volts and the bias resistance 58 ohms, then we have the actual amperage$_{LED,actual}$ 103 mA and the power loss $P_{tot}$ 1.65 watts.

This shows that the power loss at the upper voltage limits, in this example at 16 volts, has risen to more than double, compared to a rated voltage of 13.5 volts.

But if the lamp is operated at 16 volts with the triggering circuit described, then the power loss $P_{tot}$ is substantially less. In the example, it is assumed that the ratio of LED and is proportional to the brightness, for example in that the double amperage corresponds to a double brightness. The key ratio turns out to be:

$$D=\frac{U_{bat,nom}-U_{F,Dioden}}{U_{bat,actual}-U_{F,Dioden}}$$

So the pulsing begins at voltages lying above rated. The power loss calculates to:

$$P_{tot}=U_{bat}\cdot I_{LED,actual}\cdot D$$

Here the actual amperage of the LEDs figures out to:

$$I_{LED,actual}=\frac{(U_{bat}-U_{F,Dioden})}{R_{nom}}$$

For the rated battery voltage $U_{bat,nom}$, 16 volts is assumed; for the diode voltage $U_{f,diodes}$, 2.5 volts, and for the bias resistance R, 59 ohms. At an assumed key ratio of D=0.58, on the basis of the above relationship we get a power loss $P_{tot}$ of only 0.955 watts. Therefore the reduction of the power loss by the pulsed operation is 0.955 watts/1.65 watts=42%.

With the use of the triggering circuit, the effective current is kept about constant in pulse mode, so that the particular illuminating field in pulse mode seems always about equally bright.

The illuminating fields 1, 3, 5 are operated independently of each other. Depending on the input signal, the microcontroller 13 generates the corresponding pulse width for pulsed operation for each illuminating field. The illuminating fields 1, 3, 5 can be provided in a single lamp. Such a lamp may for example be the tail lamp of a motor vehicle. Then the illuminating fields are for example the brake light, the reverse light or the blinker. Alternatively, however, a lamp may be provided for one illuminating field at a time. The distribution of the illuminating means 2, 4 on a single or over several lamps may be determined arbitrarily. Thus each of the illuminating fields 1, 3, 5 may comprise more or fewer than the four illuminating means 2, 4 represented by way of example.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A control system for controlling a light source, said system comprising:

at least one light source being responsive to a voltage signal that causes the light source to be illuminated;

a triggering circuit also being responsive to the voltage signal applied to the at least one light source, said triggering circuit detecting the magnitude of the voltage signal; and at least one switch being electrically coupled to the at least one light source and the triggering circuit, said triggering circuit maintaining the switch in a closed position to allow the at least one source to be continuously illuminated if the voltage signal is at or below a predetermined voltage value and applying a pulsed signal to the at least one switch if the voltage signal exceeds the predetermined voltage value where the switch is closed during the pulses to turn on the at least one light source and the switch is opened between the pulses to turn off the at least one light source.

2. The system according to claim 1 wherein the triggering circuit changes the pulse width of the pulsed signal depending on how much greater the voltage signal is than the predetermined voltage value so that the brightness of the at least one light source remains substantially constant when the voltage signal is greater than the predetermined voltage value.

3. The system according to claim 1 wherein the at least one light source is a plurality of light sources and the at least one switch is a plurality of switches where each light source includes a separate switch, and wherein the triggering circuit detects the voltage signal applied to each light source and separately controls each switch so that the pulsed signal applied to each switch has a pulse width depending on the magnitude of the voltage signal of each light source above the predetermined voltage value.

4. The system according to claim 1 wherein the at least one light source includes a plurality of LEDs.

5. The system according to claim 1 wherein the at least one switch is a MOSFET switch.

6. The system according to claim 1 wherein the system and light source are on a vehicle.

7. The system according to claim 1 wherein the pulsed signal from the triggering circuit has a frequency high enough so that a flicker caused by the light source is not visually detectable.

8. The system according to claim 1 wherein the predetermined voltage value is below a rated voltage of the at least one light source.

9. The system according to claim 1 wherein the triggering circuit is an integrated circuit chip.

10. A control system for controlling a light source, said system comprising:

a plurality of light sources, where each light source includes a plurality of LEDs, each light source being responsive to a voltage signal that causes the LEDs to be illuminated;

a triggering circuit also being responsive to the voltage signals applied to the plurality of light sources, said triggering circuit detecting the magnitude of the voltage signals; and a plurality of switches, each switch being electrically coupled to one light source and all of the switches being electrically coupled to the triggering circuit, said triggering circuit maintaining the switch in a closed position to allow the light source to be continuously illuminated if the voltage signal for a particular light source is at or below a predetermined voltage value, said triggering circuit applying a pulsed signal to the switch if the voltage signal for that switch exceeds the predetermined voltage value where the switch is closed during the pulses to turn on the LEDs and the switch is opened between the pulses to turn off the LEDs, wherein the triggering circuit changes the pulse width of the pulsed signal depending on how much greater the voltage signal is than the predetermined voltage value so that the brightness of the light source remains substantially constant when the voltage signal is greater than the voltage value.

11. The system according to claim 10 wherein the switches are MOSFET switches.

12. The system according to claim 10 wherein the light sources and the system are on a vehicle.

13. The system according to claim 10 wherein the pulsed signal from the triggering circuit has a frequency of at least 100 Hertz so that a flicker caused by the light source is not visually detectable.

14. The system according to claim 10 wherein the predetermined voltage value is below a rated voltage of the light sources.

15. A method for controlling a light source, said method comprising:

applying a voltage signal to at least one light source that causes the light source to be illuminated;

detecting the voltage signal;

maintaining a switch in a closed position if the detected voltage signal is less than a predetermined voltage value; and applying a pulsed signal to the switch if the voltage signal is greater than the predetermined voltage value so that the light source is on during the pulses and is off between the pulses.

16. The method according to claim 15 wherein applying a pulsed signal to the switch includes changing the pulse width of the pulse signal depending on how much greater the voltage signal is than the predetermined voltage value so that the brightness of the at least one light source remains substantially constant when the voltage signal is greater than the predetermined voltage value.

17. The method according to claim 15 wherein applying a voltage signal to the at least one light source includes applying a voltage signal to a plurality of light sources, and wherein detecting the magnitude of the voltage signal includes detecting the magnitude of all of the voltage signals, and wherein maintaining a switch in a closed position includes maintaining each switch in a closed position if the detected voltage signal for the light source coupled to the switch is less than the predetermined voltage value, and wherein applying a pulsed signal to the switch if the voltage signal is greater than the predetermined voltage value includes applying a pulsed signal to each switch for the light source whose voltage signal is greater than the predetermined voltage value.

18. The method according to claim 15 wherein the at least one light source includes a plurality of LEDs.

19. The method according to claim 15 wherein the switch is a MOSFET switch.

20. The method according to claim 15 wherein the light source is on a vehicle.

21. The method according to claim 15 wherein applying a pulsed signal to the switch includes applying a pulsed signal to the switch that has a frequency of at least 100 Hertz so that a flicker caused by the light source is not visually detectable.

22. The method according to claim 15 wherein the predetermined voltage value is below a rated voltage of the at least one light source.

* * * * *